US008317314B2

(12) United States Patent
Kohne et al.

(10) Patent No.: US 8,317,314 B2
(45) Date of Patent: Nov. 27, 2012

(54) SYSTEM AND METHOD FOR IMPROVING THROUGHPUT FOR PRINTING OPERATIONS IN AN INDIRECT PRINTING SYSTEM

(75) Inventors: Jeffrey R. Kohne, West Linn, OR (US); Brent R. Jones, Sherwood, OR (US); Michael E. Jones, West Linn, OR (US); Daniel Clark Park, West Linn, OR (US); Michael C. Gordon, West Linn, OR (US); Joseph B. Gault, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 371 days.

(21) Appl. No.: 12/720,497

(22) Filed: Mar. 9, 2010

(65) Prior Publication Data

US 2011/0221804 A1 Sep. 15, 2011

(51) Int. Cl.

| | |
|---|---|
| ***B41J 29/38*** | (2006.01) |
| ***B41J 29/393*** | (2006.01) |
| ***B41J 2/01*** | (2006.01) |

(52) U.S. Cl. ..... 347/103; 347/14; 347/19; 347/9

(58) Field of Classification Search ..... 347/9, 103, 347/14, 16, 19

See application file for complete search history.

(56) References Cited

U.S. PATENT DOCUMENTS

| | | | |
|---|---|---|---|
| 4,429,990 | A | 2/1984 | Tamary |
| 4,593,992 | A | 6/1986 | Yoshinaga et al. |
| 4,920,382 | A | 4/1990 | Mills et al. |
| 5,132,739 | A | 7/1992 | Mauer et al. |
| 5,325,155 | A | 6/1994 | Perry |
| 5,327,204 | A | 7/1994 | Sculley et al. |
| 5,353,107 | A | 10/1994 | Sculley et al. |
| 5,523,830 | A | 6/1996 | Tamura et al. |
| 5,610,721 | A | 3/1997 | Higuchi et al. |
| 5,870,650 | A | 2/1999 | Takahashi et al. |
| 6,035,157 | A | 3/2000 | Takahashi et al. |
| 6,072,978 | A | 6/2000 | Wittmann |
| 6,141,524 | A | 10/2000 | Berkes et al. |
| 6,173,136 | B1 | 1/2001 | Fuchiwaki et al. |
| 6,176,575 | B1 | 1/2001 | Crawford et al. |
| 6,263,174 | B1 | 7/2001 | Fuchiwaki et al. |
| 6,449,455 | B1 | 9/2002 | Lebold et al. |
| 6,731,891 | B1 | 5/2004 | Calamita et al. |
| 6,763,219 | B2 | 7/2004 | Kobayashi et al. |
| 6,954,603 | B2 | 10/2005 | Brown et al. |
| 6,973,877 | B2 | 12/2005 | Jensen |
| 7,065,308 | B2 | 6/2006 | Calamita et al. |
| 7,283,271 | B2 | 10/2007 | Sesek et al. |
| 7,310,492 | B2 | 12/2007 | Kimura |
| 7,362,994 | B2 | 4/2008 | Zess et al. |

(Continued)

*Primary Examiner* — Jason Uhlenhake

(74) *Attorney, Agent, or Firm* — Maginot, Moore & Beck, LLP

(57) ABSTRACT

A printer is configured with a controller that transforms operation of the printer to increase throughput. The printer includes an image receiving member, a printhead configured to eject ink drops onto the image receiving member to form an ink image, a transfix roller configured to move towards and away from the image receiving member to form a transfixing nip with the image receiving member selectively, a release agent applicator configured to engage the image receiving member selectively to apply release agent to the rotatable imaging member, and a controller configured to generate firing signals that operate the printhead from image data and to transform operation of the printer from a first printing process sequence to a second printing process sequence in response to a coverage parameter for image data to be printed being less than a predetermined threshold.

17 Claims, 3 Drawing Sheets

U.S. PATENT DOCUMENTS

| | | | |
|---|---|---|---|
| 7,376,378 | B2 | 5/2008 | Van Bortel |
| 7,390,084 | B2 | 6/2008 | Folkins |
| 7,458,671 | B2 | 12/2008 | Leighton et al. |
| 2006/0066657 | A1 | 3/2006 | Folkins et al. |
| 2006/0239728 | A1 | 10/2006 | Van Bortel |
| 2007/0020002 | A1 | 1/2007 | Zess et al. |
| 2007/0110457 | A1 | 5/2007 | Kato et al. |
| 2007/0139496 | A1 | 6/2007 | Leighton et al. |
| 2007/0146459 | A1 | 6/2007 | Gault et al. |
| 2007/0146460 | A1 | 6/2007 | Gordon et al. |
| 2007/0146461 | A1 | 6/2007 | Islam et al. |
| 2010/0245447 | A1* | 9/2010 | Kohne et al. ..... 347/16 |

* cited by examiner

| CATEGORY | DESC. | DEFAULT | SHORTENED DM DISTANCE | SHORTENED TRANSFIX DISTANCE | BOTH SHORTENED DM AND TRANSFIX DISTANCES | (UNITS) |
|---|---|---|---|---|---|---|
| IMAGING | # DRUM REVS | 3 | 3 | 3 | 3 | |
| | DIA DRUM | 160.0 | 160.0 | 160.0 | 160.0 | mm |
| | CIRCUM DRUM | 502.4 | 502.4 | 502.4 | 502.4 | mm |
| | FIRE RATE | 23000 | 23000 | 23000 | 23000 | hz |
| | Y-RES | 600 | 600 | 600 | 600 | dpi |
| | IMAGING TIME | 1.56 | 1.56 | 1.56 | 1.56 | sec |
| TRANSFIX | PITCH 1 LENGTH | 8.5 | 8.5 | 8.5 | 8.5 | in |
| | PITCH 2 LENGTH | 8.5 | 8.5 | 4.5 | 4.5 | in |
| | INTER COPY ZONE LENGTH | 0.4 | 0.4 | 0.4 | 0.4 | in |
| | TRANSFIX VEL | 40 | 40 | 40 | 40 | ips |
| | TRANSFIX DISTANCE | 17.4 | 17.4 | 13.4 | 13.4 | in |
| | TRANSFIX TIME | 0.44 | 0.44 | 0.34 | 0.34 | sec |
| OVERHEAD | # DRUM REVS | 0.8 | 0.6 | 0.8 | 0.6 | rev |
| | DRUM DISTANCE | 401.92 | 301.44 | 401.92 | 301.44 | mm |
| | AVERAGE SPEED | 1000 | 1000 | 1000 | 1000 | mm/s |
| | TIME | 0.40 | 0.30 | 0.40 | 0.30 | sec |
| SUMMARY | SUM | 2.40 | 2.30 | 2.30 | 2.20 | sec |
| | # PRINTS PER CYCLE | 2 | 2 | 2 | 2 | (FOR A LEF) |
| | PRINT SPEED | 50.0 | 52.1 | 52.1 | 54.5 | PPM |

FIG. 2

SYSTEM AND METHOD FOR IMPROVING THROUGHPUT FOR PRINTING OPERATIONS IN AN INDIRECT PRINTING SYSTEM

TECHNICAL FIELD

This disclosure relates to indirect printing systems and, more particularly, to control of the image receiving member and transfix roller in such systems.

BACKGROUND

Droplet-on-demand ink jet printing systems eject ink droplets from print head nozzles in response to pressure pulses generated within the print head by either piezoelectric devices or thermal transducers, such as resistors. The ejected ink droplets, commonly referred to as pixels, are propelled to specific locations on an image receiving member where each ink droplet forms a spot on the member. The print heads have droplet ejecting nozzles and a plurality of ink containing channels, usually one channel for each nozzle, which interconnect an ink reservoir in the print head with the nozzles.

In a typical piezoelectric ink jet printing system, the pressure pulses that eject liquid ink droplets are produced by applying an electric pulse to the piezoelectric devices, one of which is typically located within each one of the inkjet channels. Each piezoelectric device is individually addressable to enable a firing signal to be generated and delivered for each piezoelectric device. The firing signal causes the piezoelectric device receiving the signal to bend or deform and pressurize a volume of liquid ink adjacent the piezoelectric device. As a voltage pulse is applied to a selected piezoelectric device, a quantity of ink is displaced from the ink channel and a droplet of ink is mechanically ejected from the nozzle, commonly called an inkjet or jet, associated with each piezoelectric device. The ejected droplets form an image on the image receiving member opposite the print head. The respective channels from which the ink droplets were ejected are refilled by capillary action from an ink supply.

In some phase change or solid ink printers, the image receiving member is a rotating drum or belt coated with a release agent and the ink medium is melted ink that is normally solid at room temperature. The print head ejects droplets of melted ink onto the rotating image receiving member to form an image, which is then transferred to a recording medium, such as paper. The image receiving member is prepared for receipt of the ejected ink by the application of release agent to an imaging area on the image receiving member by a drum maintenance unit or other release agent applicator. The layer of release agent on the image receiving member forms a surface on which the ink image is formed and facilitates the transfer of the ink image from the receiving member to a recording medium. The transfer is generally conducted in a nip formed by the rotating image member and a rotating pressure roller, which is also called a transfix roller. The pressure roller may be heated or the recording medium may be pre-heated prior to entry in the transfixing nip. As a sheet of paper is transported through the nip, the fully formed image is transferred from the image receiving member to the sheet of paper and concurrently fixed thereon. This technique of using heat and pressure at a nip to transfer and fix an image to a recording medium passing through the nip is typically known as "transfixing," a well known term in the art, particularly with solid ink technology.

The time required for image generation and transfer is essentially fixed in a printer by frequency at which the inkjet ejectors can be operated and the overhead operations required to prepare the image receiving member and to transfer the image from the image receiving member to recording media. In previously known printing systems, the application of the release agent to the image receiving member occurs over the full expected imaging region of the member. Likewise, the transfix operation has always been performed by engaging the image receiving member with the transfix roller near the media leading edge and withdrawing the roller at or near the trailing edge of the media. The release agent application and transfix cycles operate at a slower drum speed than imaging or media exit so the total time for image generation and transfer is affected. Printing in a manner that improves throughput without degrading image receiving member preparation or the efficiency of image transfer to recording media would be useful.

SUMMARY

A printer has been developed that monitors image content to be printed and transforms operation of the printer with a printing process sequence to increase image throughput without degrading image quality. The printer includes an image receiving member, a printhead configured to eject ink drops onto the image receiving member to form an ink image, a transfix roller configured to move towards and away from the image receiving member to form a transfixing nip with the image receiving member selectively, a release agent applicator configured to engage the image receiving member selectively to apply release agent to the rotatable imaging member, and a controller configured to generate firing signals that operate the printhead from image data and to transform operation of the printer from a first printing process sequence to a second printing process sequence in response to a coverage parameter for image data to be printed being less than a predetermined threshold.

A method has been developed for transforming operation of a printer to increase image throughput without degrading image quality. The method includes comparing a coverage parameter for image data to be printed to a predetermined coverage threshold, and transforming operation of the printer from a first printing process sequence to a second printing process sequence in response to the coverage parameter being less than the predetermined threshold.

BRIEF DESCRIPTION OF THE DRAWINGS

The foregoing aspects and other features of a system that evaluates image content of images to control the printing process sequence are explained in the following description taken in connection with the accompanying drawings.

FIG. 2 is a table identifying examples of printing process operations and parameter values that may be altered to transform printer operation and increase image throughput.

DETAILED DESCRIPTION

Figure 1:
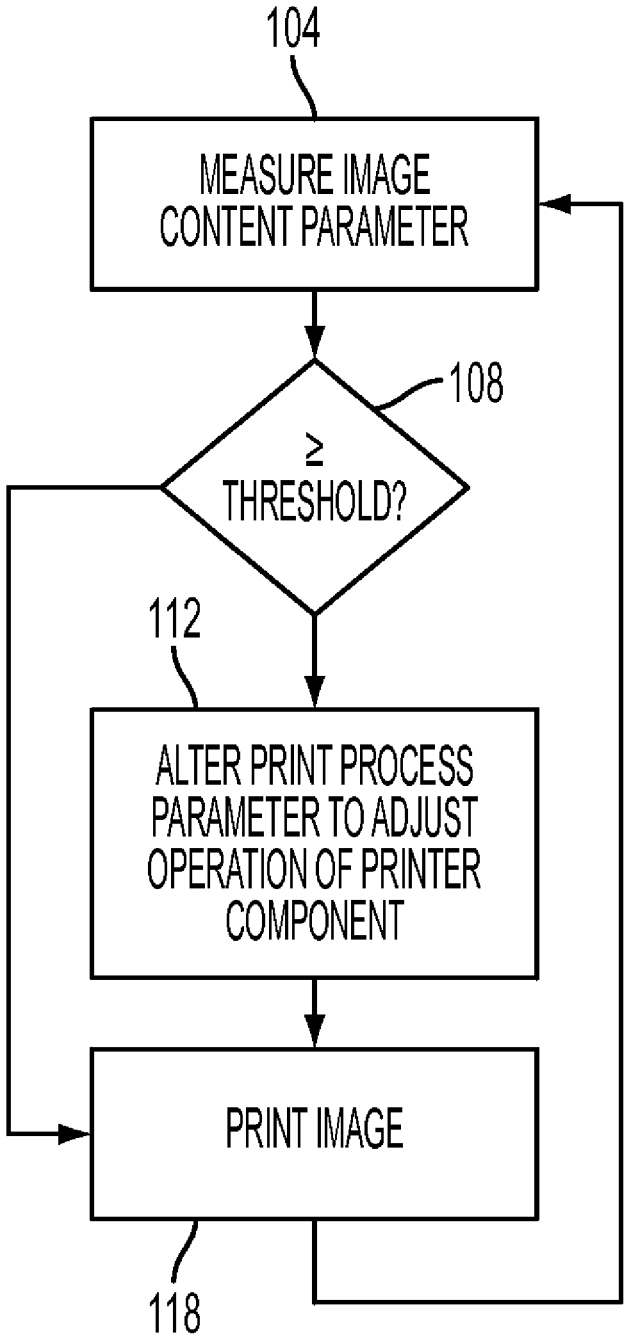
FIG. 1 is a flow diagram of a process that evaluates image content of images to be printed and selects a printing process sequence based on printing process sequence criteria and then transforms printer component operation in accordance with that selection.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like. The description presented below is directed to a printing system that monitors image content and adjusts the motion of at least one of the image receiving member, transfix roller, and release agent applicator to increase the throughput of media sheets. A "media sheet" as used in this description may refer to any type and size of medium that printers in the art create images on, with one common example being letter sized printer paper. Additionally, the printing system described below may have embodiments that can monitor image content of images that will be placed onto media sheets, and determine whether the system may be adjusted to increase throughput based on this image content. The image receiving member is typically a rotating drum, but may be a band, platen, or the like.

Drum maintenance (DM) operations are discussed below. One purpose of DM operations is to apply release agent to the image receiving member and to meter the release agent with a blade to make the release agent layer more uniform. Typically, the release agent is applied to the entire document image area(s). As described more fully below, a modified DM operation includes a truncated DM cycle, a partial DM cycle or an omission of a DM cycle in response to a previous and/or current image having an image density that is less than a predetermined threshold. The image content measurement and comparison is based on image size relative to media parameters, the thresholds that have been determined for various conditions, and other image objectives, such as final print quality. As an example, text, mono color graphic and color graphics, in addition to media type and image resolution (print quality) setting, may use different thresholds for determining whether one of the various modified DM operations should be implemented. In some cases, the modified DM operation occurs within a transfix and/or a media exit process. A partial DM cycle includes the removal of the release agent applicator from the image receiving member at a position determined with reference to the image density or content, but the metering blade remains in contact with the image receiving member through all or a portion of the balance of the current document image area. The metering blade may be retracted beyond an image or media edge position or otherwise in such a way as not to leave an oil artifact that would affect the image or otherwise be noticeable on the media image. An additional example of a modified DM operation is one in which the metering blade alone is brought into contact with the image receiving member.

Transfix operations are also discussed below. In transfix operations a transfix member is moved into contact with the image receiving member to form a nip through which media passes to receive an ink image from the image receiving member. Typically, the transfix member remains in contact with the image receiving member throughout the entire document image area(s) at the pressure required for effective transfer of the ink image from the image receiving member to the media. As described more fully below, modified transfix operations may include operational variations implemented in response to comparisons of image content measurements being less than or greater than predetermined thresholds. These operational variations may include rotation of the image receiving member at a speed other than a nominal transfix velocity. This different speed is generally faster than the nominal speed to increase throughput, but the different speed may be a reduced velocity. Velocity modifications may be constant or variable or implemented over all or a portion of the transfix process. Modified transfix operations may also include varying the location on the image receiving member at which the transfix roller is set down or lifted off as well as the level of pressure applied by the transfix roller to the image receiving member. Modified transfix operations are performed in response to a previous and/or current image having an image density that is less than a predetermined threshold. The image content measurement and comparison is based on image size relative to media parameters, the thresholds that have been determined for various conditions, and other image objectives, such as final print quality. As an example, text, mono color graphic and color graphics, in addition to media type and image resolution (print quality) setting, may use different thresholds for determining whether one of the various modified transfix operations should be implemented. Transfix roller set down on the image receiving member includes setting the transfix roller down on the print drum or other imaging surface or setting the transfix roller down on media that is to receive an image from the imaging surface.

The various modified DM and transfix operations discussed above may be performed independently of one another. These different DM and transfix operations make possible an array of printing operation modifications for a variety of situations to enhance throughput within a given image quality objective. For example, one operation variable that may be employed is to revise the order of independent images in the queue as they are imaged to maximize the benefit of a current image receiving member condition or some modified operation involving the image receiving member. These changes in combination with optimum modified transfix operations can enable significant throughput gains to be obtained. Another example of enhanced throughput would arise from the production of multiple images on different pitches of the image receiving member with a single DM cycle and imaging process and then truncating the transfix operation appropriately to prevent all or a portion of a subsequent image from being transferred to the current imaged media sheet. Media transport rollers operate independently from the image receiving member so image receiving member velocity can be phased or driven with any non-matching velocity profile to facilitate this process. Another example, which is similar to the above described scenario, includes the truncation of the DM operation to less than all the areas to be imaged, or if previous and current image content allows, the DM operation may be omitted completely.

A process for altering operation of a printer to accommodate varying image content is shown in FIG. 1. The process begins with measurement of image content for an image to be printed (block 104). The term 'image content' is described in more detail below. Image content may be determined at certain times relative to operation based on sophistication or configuration of the printing device. As example, image content may be determined prior to actual imaging, such as by analysis of an image as it is "ripped", determined concurrent with imaging, such as by counting pixels within predetermined regions, or determined after completing an image, such as by scanning the image on the offset drum before transfer or on media sheets, if directly printed or after transfer, if transferred from an imaging member.

With continued reference to FIG. 1, the measured image content parameter is compared to a predetermined threshold (block 108). If the measurement is greater than the predetermined threshold, then the image is printed with a default printing process (block 116). If the measurement is equal to or less than the predetermined threshold, then a print process parameter is altered to adjust operation of a printer component (block 112). The image is then printed (block 116). Print process parameters, also termed process profile, process control or similar term variations, may be adjusted independently for simplex and duplex operation, and may or may not be different depending on the full range of variables for the print process to be used to produce an image. Process parameters within those two basic modes of operation may be altered in limited fashion, such as the example discussed below, or may be very extensive, even though some profiles may be subtly different in some aspects. One example might be monitoring image receiving member temperature over a large batch print job where temperature could unavoidably rise above a nominal operation window and in response, the transfix velocity profile and transfix load may be altered. The change in process parameters in this example would not be optimized for image transfer efficiency or image quality results alone but rather, consistent with the focus of the systems and methods described herein, which may not be present in other implementations, but instead may be performed as an optimization compromise between image quality, image throughput, and oil consumption.

One of the print process parameters altered below is described as velocity or speed. The term velocity or speed is used throughout this document as a reference to any steady state rate of motion, any varying motion due to acceleration or deceleration, or any combination of steady state, acceleration and deceleration motion throughout or during a portion of a particular operation of an image receiving member, or other motor driven component used in an imaging operation of the printer. For example, while a lower speed or velocity may be used to provide an advantage under some circumstances, a higher velocity or speed may be useful for other circumstances. Such a reference could also be understood to mean multiple different speeds, continuously variable speed profiles, and so forth. The range of variables contributing to attaining maximum throughput in conjunction with minimal compromise to image quality offer challenges for any particular imaging system and image job so these variables are not subject to strict formulation. Rather, the variables selected and their value ranges are flexible for intelligent automated optimization of the imaging process. The variables include but may not be limited to motion control, transfix load, image density by region of the image, color content, simplex or duplex printing, number of image repetitions, thermal changes over applicable conditions (environment or duration of print job), media type, number of images to be produced in a given job, and the intended image quality based on resolution. Consequently, numerous process profiles may be employed to attain the best balance of objectives, including those affected by user input, such as media type and image resolution. Central to these print parameter adjustment factors is knowledge about the images being produced. Intelligent action taken based on image analysis may therefore be partly formulation, where optimization is based upon known trends, and partly unique observation based on a given system, where weighting and values may be assigned to those trends within practical limits of a particular product implementation.

When measuring image content, the printer being described is being operated with reference to the image content of one or more print images used to generate ink images. These images may be denoted as a current print image, a previous print image, or a next print image. As used herein, the terms print image and current print image refer to the image being executed. The term next print image refers to an image that may have been at least partially processed by the controller, but not yet executed. Next print image may also be understood as "no subsequent print job," if no immediate print job follows the current image. The term previous print image refers to a print that has already been executed, and a measurement of its image content retained in a form that enables the measurement to be used to alter the print process of the current print image. In the context of a duplex print image, the current print image may be the first side printed and the next print image may be the second side printed. The term executed refers to the process in which the printer implements making a print by, for example, applying release agent to an image receiving member, ejecting ink from one or more printheads to form an ink image on the image receiving member, and transfixing the ink onto a recording medium, such as a sheet of media, by feeding the recording medium between a nip formed by the image receiving member and a movable transfix roller.

As used in this document, measuring image content of a print image refers to a process in which the attributes of a print job are determined and placed in a format that can be utilized in logical decisions and analysis for operation of the imaging device. Examples of a measurement, which may be referred to as a score, include, but are not limited to, counting, tallying, finding a maximum, finding a minimum, calculating (such as a percentage), converting to an integer scale, or the like. Examples of attributes include, but are not limited to, the total number of pixels in an area to be printed, the number of pixels within specified areas of a total image to be executed, the spatial relationship between the ink on the image receiving member and the media sheet or other printer components, the quantity or occurrence of pixel patterns in a print image, the nature of the colors present, or the like. The logical decisions and analysis performed with reference to the attributes may be the same or different based on whether the image is a current print image, a next print image, or a previous print image. For example, comparison of an image content measurement to a predetermined threshold may use the same or different thresholds for current print images, next print images, or previous print images. Additionally or alternatively, other criteria such as duty cycle or a thermal state may be used to govern a logical decision or analysis. Also, comparisons described in this document are frequently described as exceeding a threshold. This description is meant to encompass the value being greater than the threshold or less than the threshold depending on the context of the comparison. Thus, exceeding a threshold may refer to a value greater than a maximum in one context and referring to a value less than a minimum in another context.

Printing parameters that affect the length of a printing cycle and possible transformations that increase image throughput are shown in FIG. 2. The leftmost column of the table in FIG. 2 identifies three printing process operations: imaging, transfix, and overhead. The imaging operation of the printing process includes the generation of the firing signals and the ejection of the ink from the printheads onto the image receiving member to form an ink image on the image receiving member. The transfix operation refers to the formation of the transfix nip with the transfix roller and the image receiving member, the transfer of the ink image from the image receiving member to media passing through the nip, and the disengagement of the transfix member from the image receiving member. The overhead operation of the printing process describes the image data rendering for generation of the firing signals, cleaning of the image receiving member, application of release agent to the image receiving member, and related activities in preparation for additional imaging and transfix operations. For each operation, a number of print parameters are described and parameter values are identified in the table for various printing process sequences. Operation time references show the basis for throughput improvement based on modifications to the operation process sequences. The particular values contained within this table are an example printing process where processes are truncated to roughly 50% of a sheet length.

For the imaging operation in the table of FIG. 2, the number of image receiving member revolutions, the diameter and circumference of the image receiving member, the operational frequency of the inkjet ejectors, the printing resolution in the process direction, and time for formation of an ink image are the identified parameters. Thus, for the image receiving member having the circumference and diameter shown in the table being rotated through six revolutions to form one or more ink images at the process resolution and firing frequency, the imaging operation requires 1.56 seconds. As shown in the table, this printing process operation remains unchanged between the print processes shown.

For the transfix operation, two pitch lengths, an inter-copy zone length, a transfix velocity, and a transfix time are identified. "Pitch" refers to an imaging area on the image receiving member. In the embodiment described by the table in FIG. 2, each pitch is 8.5 inches in length and the pitches are separated by the inter-copy zone length of 0.4 inches. Thus, the transfix distance in the default printing process sequence is 17.4 inches to enable the full length of both pitches and the inter-copy zone to pass through the nip and transfer the ink image in each pitch to two media sheets also passing through the zone. At the typical image receiving member rotational speed for transfix operations, 0.44 seconds are required for the transfix distance to pass through the transfix nip. As discussed below, the length of the transfix distance or velocity can be changed to decrease the time of the transfix operation and increase throughput.

For the overhead operation, the number of image receiving member revolutions, distance through which the image receiving member is rotated, the average speed at which the image receiving member is rotated during overhead operation, and the time required for the overhead operation are identified in the table of FIG. 2. As shown in the table, the default values for the application of release agent and associated preparatory actions require 0.4 seconds. As discussed below, the length of the overhead distance can be changed to decrease the time of the overhead operation and increase throughput. The summary portion of the table identifies the total time, number of prints per cycle, and pages printed per minute capable with each printing process sequence identified in the table.

Four printing process sequences are identified in the top margin of the table shown in FIG. 2. These four process sequences are a default process sequence, a shortened drum maintenance (DM) sequence, a shortened transfix sequence, and a shortened drum maintenance/transfix sequence. The default sequence refers to the controller for the printer being configured with programmed instructions to form ink images on an image receiving member in the nominally required multiple revolutions of the image receiving member, which may vary by product. Note that this operation is invariant in the embodiments discussed herein. The default operations utilize a maximum distance for both release agent application and transfix roller engagement for a given media size. The shortened DM sequence refers to a controller configuration that reduces the length of the pitches or imaging areas on the image receiving member that receive release agent from a release agent applicator in the printer. Consequently, the controller operates the release agent applicator to engage the image receiving member over a shorter distance. In the example depicted in the table, the release agent engages the image receiving member for only 0.6 revolutions rather than for the 0.8 revolutions of the default sequence. Once the release agent applicator is disengaged from the image receiving member, the controller increases the rotational speed of the image receiving member for the remainder of that operation. In the embodiment described in the table of FIG. 2, the decreased distance for release agent application in the shortened DM sequence enables the overhead operation to be completed in 0.3 seconds rather than the 0.4 seconds of the default sequence.

With continued reference to the table of FIG. 2, the shortened transfix sequence refers to a controller configuration that reduces the distance for engagement of the transfix roller to the image receiving member engagement that is made possible because the ink image does not completely fill the imaging area on the image receiving member. Consequently, in this example, the controller operates the transfix roller to engage the image receiving member for only 13.4 inches rather than the 17.4 inches of engagement performed in the default sequence. In the embodiment described in the table of FIG. 2, the decreased distance for a transfix operation in the shortened transfix sequence enables the transfix operation to be completed in 0.34 seconds rather than the 0.44 seconds of the default sequence. Large format printers may have an image receiving member that is sufficiently long to accommodate multiple images, each being transferred to different media sheets. In one embodiment, the transfix roller moves away from the image receiving member after a portion, or depending upon image content, the full length of a first image and corresponding media pitch has passed through the nip, increasing the rotational speed of the image receiving member over that portion of the cycle that may be beyond a truncated image area. The transfix roller is then returned to reform the nip for transfixing a portion, or depending upon image content, the full length of a subsequent image and corresponding media pitch through the nip. After that portion has passed through the nip, the transfix roller is moved away from the image receiving member and the rotational speed of the image receiving member is increased again. Thus, the time for the transfix operation is shortened. In a printer in which the transfix roller is configured to apply different pressures to the image receiving member, the transfix roller may be operated by the controller to reduce the pressure applied by the transfix roller to the image receiving member while remaining engaged with the media passing through the nip for the full length of the media. At the portion of the second pitch containing the ink image to be transferred, the pressure applied by the transfix roller is increased and then the transfix roller is moved away from the image receiving member after the portion of the imaging area bearing the ink image has passed through the nip. Depending on image content, the rotational speed of the image receiving member may be increased while the transfix roller applies the reduced pressure. In another example, full transfix load pressure may be employed over portions of the image with density or content corresponding to use of normal operational processes and other portions of the image with density or content below criteria thresholds may allow lower pressures that enable higher velocity transfixing to improve throughput. Additional gains are possible by lifting the transfix roller to achieve maximum velocity as any remaining non-imaged area reaches the nip to enable multiple time saving operation modifications. Truncated operations, particularly truncated transfixing operations, provide considerable flexibility in printing operations. As example, two or more images may be produced during one imaging process on the image receiving member after application of release agent when the images do not overlap the available length. The transfix roller is lifted to eliminate the nip after transfixing each image to allow media sheet lengths that would otherwise overlap a subsequent image. This transfixing operation modification is possible because media transport rollers can pull the media sheet beyond the nip region after the transfix roller is lifted. In such a situation, image order may be sequential or non-sequential to optimize phasing of the media sheet exit to the start of the next transfixing operation.

As identified in the summary portion of the table shown in FIG. 2, operating the printer in accordance with the shortened DM sequence reduces the time for a printing process from 2.4 seconds to 2.3 seconds. Likewise, operating the printer in accordance with the shortened transfix sequence reduces the time for a printing process from 2.4 seconds to 2.3 seconds. When the printer is operated in accordance with a process that implements a shortened DM and a shortened transfix process, the time for a printing process is reduced from 2.4 seconds to 2.2 seconds. The reduced operational times correspond to increased throughput rates for the printer with the increase yielding a throughput rate of 54.5 pages per minute when the process that implements a shortened DM and a shortened transfix process is executed by the controller.

In one embodiment, the controller is configured to compare a length corresponding to image data to be printed in a pitch to a length of the pitch. If the length of the image data is less than the length of a pitch by a predetermined amount, the controller transforms the operation of the printer by selecting one or both of the shortened printing operation sequences. In one embodiment, the predetermined amount is 50% of the length of the pitch. That is, if the length of the image data is shorter than 50% of the pitch length, then one or more of the shortened printing operation sequences are selected. Although the shortened printing sequences may reduce the distance through which either the transfix roller or the release agent applicator engage the image receiving member by a fixed amount, the controller may be configured to reduce the distance for image receiving member engagement by a length corresponding to the difference between the pitch and the length of the image data. Of course, the controller also increases the rotational speed of the image receiving member after the image receiving member is disengaged from either the transfix roller or the release agent applicator.

Figure 3:
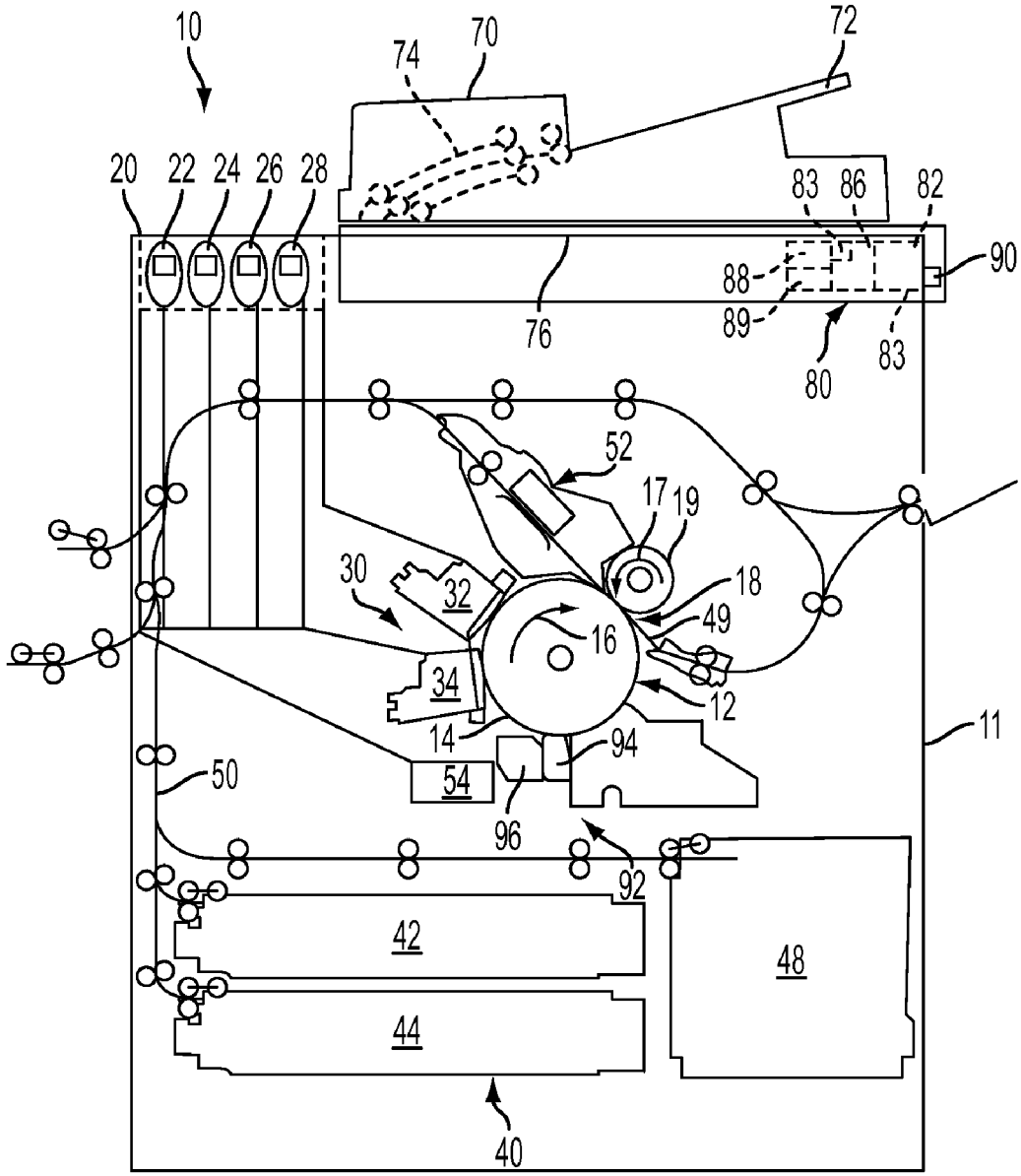
FIG. 3 is a schematic, side elevation view of an ink jet printer that implements the process shown in FIG. 1.

Referring now to FIG. 3, an embodiment of an image printing machine, such as a high-speed phase change ink image printing machine or printer 10, is depicted. As illustrated, the machine 10 includes a frame 11 to which are mounted directly or indirectly all its operating subsystems and components, as described below. To start, the high-speed phase change ink image producing machine or printer 10 includes an image receiving member 12 that is shown in the form of a drum, but can equally be in the form of a supported endless belt. The image receiving member 12 has an imaging surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a heated media sheet 49.

The high-speed phase change ink image producing machine or printer 10 also includes a phase change ink delivery subsystem 20 that has at least one source 22 of one color phase change ink in solid form. The example phase change ink image producing machine or printer 10 is a multicolor image producing machine. The ink delivery system 20 includes four (4) sources 22, 24, 26, 28, representing four (4) different colors CMYK (cyan, magenta, yellow, black) of phase change inks. The phase change ink delivery system also includes a melting and control apparatus (not shown) for melting or phase changing the solid form of the phase change ink into a liquid form. The phase change ink delivery system is suitable for supplying the liquid form to a printhead system 30 including at least one printhead assembly 32. The phase change ink image producing machine or printer 10 is a wide format high-speed, or high throughput, multicolor image producing machine. The printhead system 30 includes multiple multicolor ink printhead assemblies, 32 and 34 as shown. In the embodiment illustrated, each printhead assembly further consists of two independent printheads. The total number of four printheads are staggered so that the array covers substantially the full imaging width of the largest intended media size. Solid ink printers may have one or any number of any size printheads arranged in any practical manner.

As further shown, the phase change ink image producing machine or printer 10 includes a substrate supply and handling system 40. The substrate supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares, and manages the image data flow between image input sources, such as the scanning system 76, or an online or a work station connection 90, and the print head assemblies 32 and 34. As such, the ESS or controller 80 is the main multi-tasking processor for operating and controlling all of the other machine subsystems and functions, including the duplex printing process discussed below.

The controller 80 may be implemented with general or specialized programmable processors that execute programmed instructions. The instructions and data required to perform the programmed functions may be stored in memory associated with the processors or controllers. The processors, their memories, and interface circuitry configure the controllers to perform the processes, described more fully below, that enable the image receiving member 12 to continue to rotate during some duplex printing operations. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Multiple controllers configured to communication with the main controller 80 may also be used.

The controller is coupled to an actuator 96 that rotates the image receiving member. The actuator is an electric motor that the controller may operate at multiple speeds and also halt to carry out a printing process sequence. The controller of the present embodiment also generates signals for operating the components that position the transfix roller and the release agent applicator with reference to the image receiving member.

In operation, image data for an image to be produced are sent to the controller 80 from either the scanning system 76 or via the online or work station connection 90 for processing and output to the printhead assemblies 32 and 34. Additionally, the controller determines and/or accepts related subsystem and component controls, for example, from operator inputs via the user interface 86, and accordingly executes such controls. As a result, appropriate solid forms of differently colored phase change ink are melted and delivered to the printhead assemblies. Additionally, inkjet control is exercised with the generation and delivery of firing signals to the print head assemblies to form images on the imaging surface 14 that correspond with the image data. Media substrates are supplied by any one of the sources 42, 44, 48 and handled by substrate system 50 in timed registration with image formation on the surface 14. The timing of the transporting of the media sheets to the nip, the regulation of the rotation speed for the image receiving member, and the positioning of the transfix member and release agent applicator are performed by the processes described above for appropriate printing operations. After an image is fixedly fused to an image substrate, the image bearing substrate is delivered to an output area.

In the embodiments discussed above, the controller selectively rotates the image receiving member in accordance with one of the printing process sequences described above, while also controlling the application of release agent to the image receiving member and the transfer of ink images to media. Other printing process sequences are possible, either in addition to these processes or as alternatives to these processes. As noted above, the modified DM operations may include the omission of a DM cycle. Also, DM operations may be modified by altering the position of touchdown and/or liftoff for the release agent applicator and the metering blade, together or independently of one another. Modified transfix operations may include varying the pressure applied by the transfix roller to the image receiving member, varying the speed of rotation of the image receiving member before, during, after or between transfix operations, and changing the touchdown and liftoff positions of the transfix roller. The modifications of the DM and transfix operations may occur in response to image density measurements, image content measurements, or other image metrics indicating relatively light or heavy density, small or large coverage area, or other image characteristics for images that have been printed, are being printed, or in queue to be printed. The processes described above with reference to FIG. 2 enable the time for the transfix and overhead operations of a printing process to be reduced. Consequently, a printing cycle is completed more quickly and throughput of the printer may be increased in response to a coverage parameter for image data to be printed being less than a predetermined coverage threshold.

In the embodiments discussed above, the predetermined coverage threshold corresponds to a length of a pitch or imaging area on the image receiving member as related to specific media sizes associated with an imaging job. The tabloid or wide format printer illustrated can accommodate two full "A" (U.S. letter size) or "A4" (metric size) images with landscape orientation around the circumference of the drum, for example. Other printers, such as the typical letter size with narrower image receiving surfaces, may only accommodate one such image at a time, for media oriented for short edge feed. Of course, other media types and sizes as well as printing orientations may be accommodated with the changes in DM or transfix operations.

The term velocity or speed is used throughout this document as a reference to any steady state rate of motion, any varying motion due to acceleration or deceleration, or any combination of steady state, acceleration and deceleration motion throughout or during a portion of a particular operation of an image receiving member, or other motor driven component used in an imaging operation of the printer. The types of motion include, but are not limited to, rotational motion or linear motion. For example, while a lower speed or velocity may be used to provide an advantage under some circumstances, a higher velocity or speed may be useful for other circumstances. Such a reference could also be understood to mean multiple different speeds, continuously variable speed profiles, and so forth. The range of variables contributing to attaining maximum throughput in conjunction with minimal compromise to image quality offers challenges for any particular imaging system and image job so these variables are not subject to strict formulation. Rather, the variables selected and their value ranges are flexible for intelligent automated optimization of the imaging process. The variables include but may not be limited to motion control, transfix load, image density by region of the image, color content, number of image repetitions, thermal changes over applicable conditions (environment or duration of print job), media type, number of images to be produced in a given job, and the intended image quality based on resolution. Consequently, numerous process profiles may be employed to attain the best balance of objectives, including those affected by user input, such as media type and image resolution.

As used in this document, the coverage parameter for image data refers to a process in which the attributes of an image are determined and placed in a format that can be utilized in logical decisions and analysis for operation of the imaging device. Examples of a measurement, which may be referred to as a score, include, but are not limited to, counting, tallying, finding a maximum, finding a minimum, calculating (such as a percentage), converting to an integer scale, or the like. Examples of attributes include, but are not limited to, the total number of pixels in an area to be printed, the number of pixels within specified areas of a total image to be printed, the relationship between the ink on the image receiving member and the media or other printer components, the quantity or occurrence of pixel patterns in a print image, the nature of the colors present, or the like. The logical decisions and analysis performed with reference to the attributes may be the same or different based on whether the image is a first or second side image or an image for a first or subsequent media sheet in a plurality of media sheets. For example, comparison of an ink coverage measurement to a predetermined threshold may use the same or different thresholds for a first or second side image or an image for a first or subsequent media sheet in a plurality of media sheets. Also, comparisons described in this document are frequently described as exceeding a threshold. This description is meant to encompass the value being greater than the threshold or less than the threshold depending on the context of the comparison. Thus, exceeding a threshold may refer to a value greater than a maximum in one instance, and less than a minimum in another. As noted above, and serving as an example, a threshold may be set at a length that is approximately 50% of the length for a document imaging area on the image receiving member. Other embodiments may calculate pixel density based on a digital representation of the images to be printed stored in a memory of the disclosed printing system to determine whether the application of release agent is required for all or a portion of an imaging area on the image receiving member. For areas not requiring release agent application, the applicator may be disengaged from the image receiving member and the rotational speed of the image receiving member increased.

In operation, the controller of a printer is configured with the hardware circuitry and a memory storing programmed instructions and data that enable the controller to generate firing signals that operate the printhead from image data and to transform operation of the printer in accordance with a predetermined printing process sequence in response to a coverage parameter for image data to be printed being less than a predetermined threshold. The coverage parameter may be a parameter, such as the ones discussed above or another image content parameter. The predetermined threshold may be a printing coverage threshold, such as those discussed above, or another threshold that indicates the type of printing process sequence that is useful in transforming operation of the printer to a more optimal state. Thereafter, the controller measures image content of one or more images to be printed by the printer, selects an appropriate printing process sequence in response to the result of the comparison of the measured image content to a predetermined threshold, and then transforms the operation of the printer in accordance with the selected printing process sequence. Upon the receipt of addition image data, the controller continues to operate the printer in a similar manner.

It will be appreciated that variations of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A printer comprising:

an image receiving member;

a printhead configured to eject ink drops onto the image receiving member to form an ink image;

a transfix roller configured to move towards and away from the image receiving member to form a transfixing nip with the image receiving member selectively;

a release agent applicator configured to engage the image receiving member selectively to apply release agent to the image receiving member; and a controller configured to generate firing signals that operate the printhead from image data and to transform operation of the printer from a first printing process sequence to a second printing process sequence by transforming at least one of a drum maintenance cycle and a transfix cycle of the printer in response to a coverage parameter for image data to be printed being less than a predetermined threshold, the controller being further configured to transform the drum maintenance cycle to the second printing process sequence by operating the release agent applicator to apply release agent to only a portion of an imaging area on the image receiving member while rotating the image receiving member at a first speed and then moving the release agent applicator out of engagement with the image receiving member and increasing rotation of the image receiving member to a second speed that is greater than the first speed.

2. The printer of claim 1, the controller being further configured to transform the transfix cycle of the printer to the second printing process sequence by operating the transfix roller to engage the image receiving member with the transfix roller to form a transfix nip and rotating the image receiving member at a first speed while a portion of an imaging area on the image receiving member rotates through the nip and then moving the transfix roller away from the image receiving member and increasing rotation of the image receiving member to a second speed that is greater than the first speed.

3. The printer of claim 2 wherein the controller is further configured to transform the transfix cycle of the printer by operating the transfix roller to form the nip with the image receiving member as at least a portion of the imaging area rotates through the nip and by operating the image receiving member at the first and the second speeds in response to the coverage parameter for the image data being less than a length of the imaging area on the image receiving member.

4. The printer of claim 1, the controller being further configured to transform the drum maintenance cycle operating a release agent applicator to apply the release agent to at least a portion of the imaging area and to operate the image receiving member at the first and the second speeds in response to the coverage parameter for the image data being less than a length of the imaging area on the image receiving member.

5. The printer of claim 1 wherein the predetermined threshold is approximately 50% of a length of the imaging area on the image receiving member.

6. A printer comprising:

an image receiving member;

a printhead configured to eject ink drops onto the image receiving member to form an ink image;

a transfix roller configured to move towards and away from the image receiving member to form a transfixing nip with the image receiving member selectively;

a release agent applicator configured to engage the image receiving member selectively to apply release agent to the image receiving member; and a controller configured to generate firing signals that operate the printhead from image data and to transform operation of the printer from a first printing process sequence to a second printing process sequence by transforming at least one of a drum maintenance cycle and a transfix cycle of the printer in response to a coverage parameter for image data to be printed being less than a predetermined threshold, the controller being further configured to transform a transfix cycle of the printer to the second print process by operating the transfix roller to engage the image receiving member to form a transfix nip and rotating the image receiving member at a first speed while only a portion of an imaging area on the image receiving member rotates through the nip and then moving the transfix roller away from the image receiving member and increasing rotation of the image receiving member to a second speed that is greater than the first speed.

7. The printer of claim 6 wherein the controller is further configured to transform the transfix cycle of the printer by operating the transfix roller to form the nip with the image receiving member as at least a portion of the imaging area rotates through the nip and by operating the image receiving member at the first and the second speeds in response to the coverage parameter for the image data being less than a length of the imaging area on the image receiving member.

8. A printer comprising:

an image receiving member;

a printhead configured to eject ink drops onto the image receiving member to form an ink image;

a transfix roller configured to move towards and away from the image receiving member to form a transfixing nip with the image receiving member selectively and to apply a plurality of pressures to the image receiving member;

a release agent applicator configured to engage the image receiving member selectively to apply release agent to the image receiving member; and a controller configured to generate firing signals that operate the printhead from image data and to transform operation of the printer from a first printing process sequence to a second printing process sequence by transforming at least one of a drum maintenance cycle and a transfix cycle of the printer in response to a coverage parameter for image data to be printed being less than a predetermined threshold, the controller being configured to transform the transfix cycle of the printer by operating the transfix roller to reduce a pressure applied by the transfix roller to the image receiving member while the transfix roller remains engaged with the media in the nip and by increasing a speed of rotation for the image receiving member while the transfix roller continues to apply the reduced pressure to the image receiving member.

9. A method for operating a printer comprising:

comparing a coverage parameter for image data to be printed to a predetermined threshold; and transforming operation of the printer from a first printing process sequence to a second printing process sequence in response to the coverage parameter being less than the predetermined threshold, the operation transformation further comprising:

operating a release agent applicator to apply release agent to only a portion of an imaging area on an image receiving member while rotating the image receiving member at a first speed; and moving the release agent applicator out of engagement with the image receiving member and increasing rotation of the image receiving member to a second speed that is greater than the first speed.

10. The method of claim 9, the operation transformation further comprising:

operating a transfix roller to engage an image receiving member to form a transfix nip;

rotating the image receiving member at a first speed while only a portion of an imaging area on the image receiving member rotates through the nip;

operating the transfix roller to move away from the image receiving member; and increasing rotation of the image receiving member to a second speed that is greater than the first speed.

11. The method of claim 10 wherein the printer operation transformation occurs in response to the image length being less than the length of the imaging area by a predetermined amount.

12. The method of claim 9 wherein the printer operation transformation occurs in response to the image length being less than the length of the imaging area by a predetermined amount.

13. A method for operating a printer comprising:

comparing a coverage parameter for image data to be printed to a predetermined threshold; and transforming operation of the printer from a first printing process sequence to a second printing process sequence in response to the coverage parameter being less than the predetermined threshold, the operation transformation further comprising:

operating a transfix roller to engage an image receiving member to form a transfix nip;

rotating the image receiving member at a first speed while only a portion of an imaging area on the image receiving member rotates through the nip;

operating the transfix roller to move away from the image receiving member; and increasing rotation of the image receiving member to a second speed that is greater than the first speed.

14. The method of claim 13 wherein the printer operation transformation occurs in response to the image length being less than the length of the imaging area by a predetermined amount.

15. A method for operating a printer comprising:

comparing a coverage parameter for image data to be printed to a predetermined threshold by comparing an image length corresponding to the image data to a length of an imaging area on an image receiving member; and transforming operation of the printer from a first printing process sequence to a second printing process sequence in response to the image length being less than the length of the imaging area by a predetermined amount.

16. The method of claim 15 wherein the predetermined amount is approximately 50% of a length of the imaging area on the image receiving member.

17. A method for operating a printer comprising:

comparing a coverage parameter for image data to be printed to a predetermined threshold;

transforming operation of the printer from a first printing process sequence to a second printing process sequence in response to the coverage parameter being less than the predetermined threshold;

operating a transfix roller to engage the image receiving member at a first pressure; and operating the transfix roller to reduce the pressure applied by the transfix roller to the image receiving member to a second pressure while increasing a speed of rotation for the image receiving member.

* * * * *